US007308915B2

(12) United States Patent
Johns et al.

(10) Patent No.: US 7,308,915 B2
(45) Date of Patent: Dec. 18, 2007

(54) PACKAGING SYSTEM FOR STORING AND MIXING SEPARATE INGREDIENT COMPONENTS

(75) Inventors: Garry P. Johns, Mission Viejo, CA (US); Corey N. Johns, Mission Viejo, CA (US)

(73) Assignee: JPRO Dairy International, Inc., Mission Viejo, CA (US)

( * ) Notice: Subject to any disclaimer, the term of this patent is extended or adjusted under 35 U.S.C. 154(b) by 169 days.

(21) Appl. No.: 11/112,931

(22) Filed: Apr. 21, 2005

(65) Prior Publication Data

US 2006/0237095 A1 Oct. 26, 2006

(51) Int. Cl.
*B65B 1/04* (2006.01)

(52) U.S. Cl. ..... 141/100; 141/329

(58) Field of Classification Search ..... 141/9, 141/100, 329, 330, 364; 222/80–91, 541.1, 222/541.2; 206/219–222
See application file for complete search history.

(56) References Cited

U.S. PATENT DOCUMENTS

| | | | | |
|---|---|---|---|---|
| 2,631,521 | A | 3/1953 | Atkins | |
| 2,784,949 | A | 3/1957 | Dennon | |
| 2,876,113 | A | 3/1959 | Barton | |
| 3,404,811 | A * | 10/1968 | Cernei | 222/83 |
| 4,465,183 | A | 8/1984 | Saito et al. | |
| 4,757,916 | A | 7/1988 | Goncalves | |
| 4,982,875 | A | 1/1991 | Pozzi et al. | |
| 4,986,322 | A | 1/1991 | Chibret et al. | |
| 5,000,314 | A | 3/1991 | Fuller | |
| 5,186,323 | A | 2/1993 | Pfleger | |
| 5,209,565 | A | 5/1993 | Goncalves | |
| 5,277,303 | A | 1/1994 | Goyet et al. | |
| 5,297,696 | A | 3/1994 | Bernstein et al. | |
| 5,353,928 | A | 10/1994 | Schumacher | |
| 5,366,114 | A | 11/1994 | Bernstein et al. | |
| 5,465,835 | A | 11/1995 | Schumacher et al. | |
| 5,525,299 | A | 6/1996 | Lowe | |
| 5,735,320 | A | 4/1998 | Tune et al. | |
| 5,743,423 | A | 4/1998 | Franco | |
| 5,782,345 | A | 7/1998 | Guasch et al. | |
| 5,941,380 | A | 8/1999 | Rothman | |
| 5,984,141 | A | 11/1999 | Gibler | |

(Continued)

FOREIGN PATENT DOCUMENTS

| | | |
|---|---|---|
| EP | 0 692 235 A1 | 1/1996 |

*Primary Examiner*—Steven O. Douglas
(74) *Attorney, Agent, or Firm*—Myers Dawes Andras & Sherman LLP; Vic Lin

(57) ABSTRACT

A packaging system is provided for storing and mixing separate ingredient components. The system includes a first bottle used for storing a first ingredient component which includes a dispensing port disposed on a top end, a mixing port disposed on a bottom end, and a seal integrated within the mixing port. The system also includes a second bottle used for storing a second component ingredient which includes a bottle neck having an opening disposed therein wherein the neck is adapted to be installed into the mixing port of the first bottle. Also, an extended tip is formed on the distal end of the bottle neck. When the bottle neck of the second bottle is installed into the mixing port of the first bottle, the seal from the first bottle is broken by the extended tip from the second bottle establishing fluid communication between the first and second bottles and allowing the ingredient components to mix.

7 Claims, 7 Drawing Sheets

U.S. PATENT DOCUMENTS

| | | | | |
|---|---|---|---|---|
| 6,045,254 | A | 4/2000 | Inbar et al. | |
| 6,089,389 | A | 7/2000 | Sharon et al. | |
| 6,244,433 | B1 | 6/2001 | Vieu | |
| 6,390,342 | B1 | 5/2002 | Mabee | |
| 6,485,479 | B1 | 11/2002 | Knierbein | |
| 6,517,878 | B2 | 2/2003 | Heczko | |
| 6,527,109 | B2 | 3/2003 | Schoo et al. | |
| 6,527,110 | B2 | 3/2003 | Moscovitz | |
| 6,533,113 | B2 | 3/2003 | Moscovitz | |
| 6,540,070 | B1 | 4/2003 | Conwell | |
| 6,655,524 | B2 | 12/2003 | De Laforcade | |
| 6,668,875 | B2 * | 12/2003 | Kojima et al. | 141/38 |
| 6,709,424 | B1 | 3/2004 | Knierbein | |
| 6,814,229 | B2 | 11/2004 | Seckler | |
| 7,066,323 | B1 * | 6/2006 | Reisman | 206/222 |
| 2003/0017236 | A1 | 1/2003 | Makita et al. | |
| 2003/0153865 | A1 | 8/2003 | Connell et al. | |

* cited by examiner

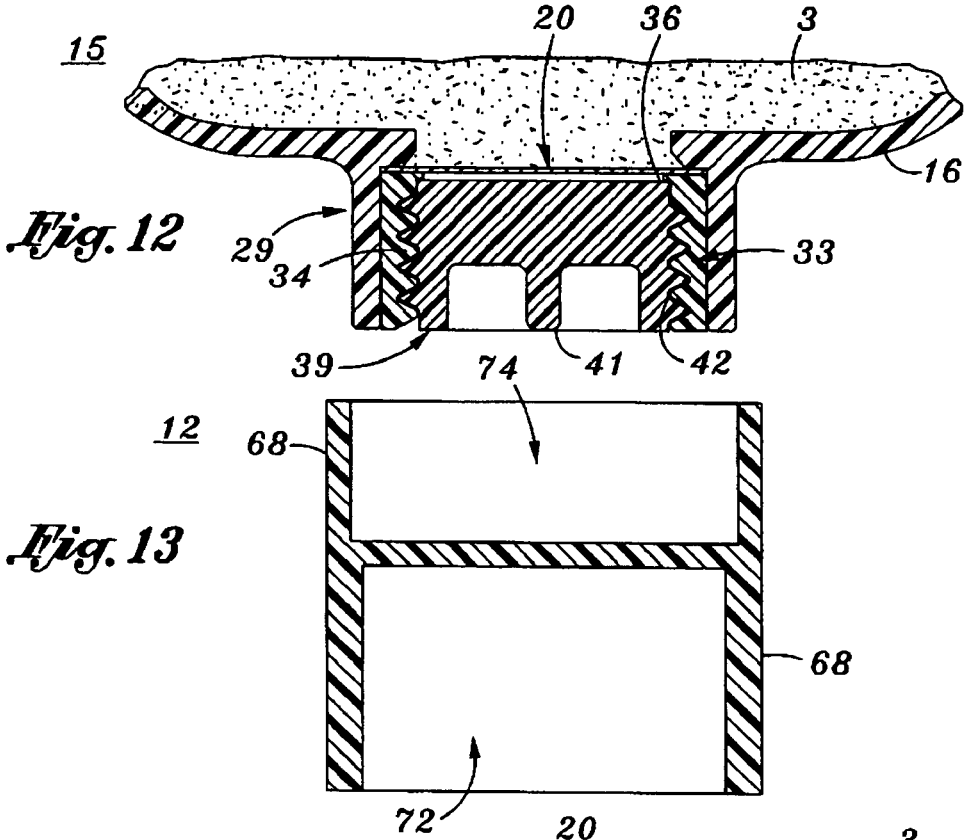
Fig. 12
Fig. 13
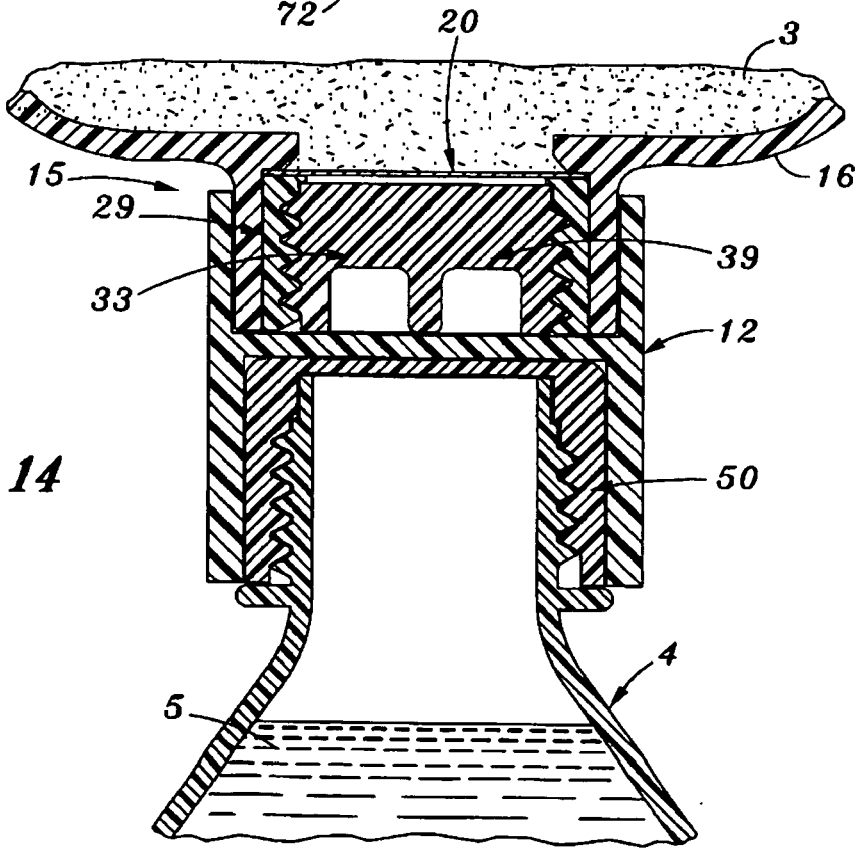
Fig. 14

PACKAGING SYSTEM FOR STORING AND MIXING SEPARATE INGREDIENT COMPONENTS

CROSS-REFERENCE TO RELATED APPLICATIONS

This application is related to co-pending U.S. patent application Ser. Nos. 11/451,996 and 11,451,857, both filed on Jun. 12, 2006.

STATEMENT RE: FEDERALLY SPONSORED RESEARCH/DEVELOPMENT

Not Applicable

BACKGROUND OF THE INVENTION

1. Field of the Invention

The present invention relates to a packaging system for storing and mixing separate ingredient components. In particular, the present invention relates to a packaging system which allows a first sealed bottle which contains a first component ingredient (such as powder, syrup or liquid) to be interconnected to a second bottle which contains a second component ingredient (such as liquid), such that the first and second components may be mixed together to reconstitute a beverage, consumable product, solution, mixture or the like.

2. Background of the Invention

There are numerous food and beverage products which are sold in powdered form and of which require water or another fluid to be mixed thereto before consumption. For example, some of the more popular products include powdered milk, flavored beverages, baby formula, diet supplements, protein shakes and cocktail mixes to name a few. Typically, the product is sold in a powdered form and must be mixed with a second liquid component, such as water or milk, before consumption. Sometimes the powdered beverage is sold in bulk as a cost savings means. That is to say, less packaging is needed per serving; therefore, the cost per serving is easily reduced. Further cost savings are realized because the consumer is left with measuring out the proper amount of powder component and adding the proper volume of liquid to prepare the beverage.

On the other hand, there are times when similar powdered beverage products (powder and liquid) are marketed in packages which provide a premeasured amount of powder supplement in a container. The container is typically designed such that it can be connected to a fluid container which holds a predetermined volume of liquid, such as a baby bottle or bottle of water. Some of the following prior art packaged systems for mixing a powder component with a liquid component are discussed below.

U.S. Pat. No. 6,527,110 B2 to Moscovitz, entitled "Device for Storing and Dispensing a Substance by Mating with a Container and Associated Methods", provides a storage device which engages a container, such as a bottle, to dispense a stored substance into the bottle. The device includes a housing for storing the substance, and a breakable seal disposed in the housing adjacent an opening for sealing the substance in the housing. Furthermore, the device includes a breaking member carried by the housing between the opening and the breakable seal for being driven by the bottle when engaged with the device to break the seal and to allow dispensing of the substance into the bottle.

U.S. Pat. No. 6,533,113 B2 also to Moscovitz, entitled "System, Devices and Methods for Storing and Mixing Substances", provides a similar system for separately storing and mixing a first and second substance. The system includes a container for the second substance and a device for storing the first substance. The device has an insertion portion for being inserted into an opening of the container, and the insertion portion has an opening and a breakable seal adjacent the opening for sealing the first substance in the device. Also, a breaking member is carried by the container and recessed inside the opening thereof for breaking the breakable seal of the device when engaged with the container to allow mixing of the first and second substances in the container.

U.S. Pat. No. 5,941,380 to Moscovitz, entitled "Device for Dispensing Flowable Material", provides a storage cap having a storage compartment, an aperture on the storage compartment, a rupturable membrane covering the aperture, and a receiving groove that engages a bottle. The storage cap is adapted for dispensing the food or drug into a typical 16 oz to 1.5 liter water bottle. A preferred embodiment of the storage cap is filled with powdered flavor concentrate, and the aperture and the receiving groove are covered with the rupturable membrane. To dispense the powdered concentrate into a bottle, the storage cap is placed with the receiving groove facing the bottle neck lip. The storage cap is then pushed against the lip which urges the rupturable membrane into the groove. As the membrane is urged into the groove, it ruptures, thus allowing the concentrate, but not the membrane, to flow into the bottle. The storage cap has a receiving groove with a large enough outer diameter, and an aperture that is narrow enough, for engaging the storage cap onto a number of different sized bottles.

U.S. Pat. No. 6,814,229 to Seckler, entitled "Bottle Adapter and Associated Methods", provides a bottle adapter which includes a connector having a containment region for holding a composition and an internal threaded portion that engages threads on a bottle neck and has an opening in fluid communication with the containment region. An upper end of the connector has an aperture that is in fluid communication with the containment region. The adapter also includes a first; seal for sealing an opening in the threaded portion and a second seal for sealing the aperture. In use a removal of the first seal permits fluid communication between the containment region and fluid in the bottle, permitting the formation of a mixture. A removal of the second seal permits the mixture to be dispensed.

U.S. Pat. No. 5,000,314 to Fuller et al., entitled "Unit Dose Package", provides a unit dose package, which is usable with a bottle to reconstruct the contents of the package, and has a plastic fitment which defines a mouth opening for the package. The plastic fitment is bonded to a wall of the package and has a channel which receives the neck of the bottle. A flexible foil membrane seal is removably attached to the plastic fitment and is covered by a protective overcap.

Although the aforementioned prior art provides a variety of solutions for mixing a first component with a second component to prepare a consumable food or beverage product, there is still a need to provide a simple component mixing system which is designed to accomplish a variety of results that the prior art lacks.

First, it would be beneficial to provide a two component mixing system for reconstituted beverages which has a simple design which may be manufactured inexpensively and marketed for one use consumption. That is to say, the packaging system should be as inexpensive as possible, since it is contemplated that the packaging system will be disposed of after the product is consumed. Most of the aforementioned prior art is much more sophisticated than is required for one use mixing systems. As a result, the mixing systems tend to add extra cost per serving.

Moreover, it would be beneficial to provide a mixing system in which each component may be packaged individually in separate facilities, marketed separately, and finally combined together at the point of use or consumption. Many of the prior art examples must be packaged at the same facility. Thus, both components have to be introduced into the packaging system before shipping. Many times such mixing systems have an increased possibility of inadvertent mixing of the components during packing or after packaging, such as during shipping, etc. On the other hand, a mixing system which allows the first and second components to be packaged in an entirely separate facility, and even marketed separately, inherently would have no problems with respect to inadvertent mixing of the components during packaging or shipping, etc.

Furthermore, it would be desirable to provide a mixing system which can, if desired, be marketed together with both components while still be optimized to meet other packaging parameters. For instance, in this scenario, it would be desirable to have a feature which allows the first component bottle to be stacked on top of the second component bottle and marketed as a complete system for reconstituted beverage. Once again, in this scenario, it would be desirable that the first and second components not necessarily be packaged together at the same plant, but have the ability to be married together at the retailer or point of purchase.

It would also further be advantageous to provide a mixing system which provides a relatively unobstructed mixing path between the first and second bottles. Some of the prior art systems provide a mixing flow path which only allows the first component to drain into the second component, but does not allow the second component to flow into the first bottle. By providing a mixing port which allows the first component to flow into the second bottle, and the second component to flow into the first bottle, the entire mixing system could be shaken together, which allows for better mixing of the first and second components.

Furthermore, it would be desirable to provide a packaging system which can be interconnected prior to the breaking or puncturing of the seal in the packaging system. Other features that would be desirable would include a component mixing system in which each bottle would be individually sealed. For instance, if each bottle was individually sealed, the mixing system would be suitable for carbonated drinks. In particular, the first bottle could contain a flavored solution, while the second bottle could contain carbonated or soda water.

Therefore, even though there are numerous examples of prior art which teach two ingredient component mixing systems, there is still a need to refine or redesign such systems such that the aforementioned needs can be met.

BRIEF SUMMARY OF THE INVENTION

The present invention is intended to overcome and solve the aforementioned problems commonly encountered with two component packaging systems for reconstituted beverages. Furthermore, the present invention provides better performance characteristics than any previously known or published approaches.

According to a first embodiment of the present invention, a packaging system is provided for storing and mixing a first ingredient component and a second ingredient component. For example, the present invention may be used for reconstituting a beverage or food product formed from two separate ingredients or perhaps, mixing two separate chemical substances together to form a desired solution. The packaging system includes a first bottle used for storing the first ingredient component. The first bottle may include an optional dispensing port disposed on a top end of the first bottle. The first bottle also includes a mixing port positioned on a bottom end of the first bottle which includes a mixing orifice disposed there through the bottom end of the first bottle. A seal is integrated within the mixing port. In a preferred embodiment, the seal covers the mixing orifice. The packaging system further includes a second bottle used for storing the second ingredient component. The second bottle includes a conventional bottle spout adapted to be installed into the mixing port of the first bottle, and an extended tip defined by a recessed portion and a recessed shoulder formed on a distal end of the spout. When the bottle spout of the second bottle is installed into the mixing port of the first bottle, the seal from the first bottle is broken by the extended distal tip formed on the second bottle, establishing an unobstructed mixing path between the first and second bottles which allows the first ingredient component to mix with the second ingredient component to create a reconstituted beverage or food product. The slices are retained to the circumference of the mixing port and do not become dislodged or mixed into the contents of the bottles.

According to another aspect of the present invention, when the spout of the second bottle is installed into the mixing port of the first bottle, the seal is broken by the extended tip into slices which are pushed in a generally upright position between the recessed portion defining the extended tip and the orifice formed in the bottom of the first bottle. It is further noted that the components from each bottle flow into either container after the seal has been broken. Therefore, in the preferred embodiment, the mixing port of the present invention provides a two-way flow path.

According to an aspect of the present invention, the packaging system further may include a modified bottle cap derived from a conventional bottle cap design, wherein the cap is adapted to be attached to the spout of the second bottle. The modified cap preferably includes a protruding shoulder adapted to receive the recessed portion of the extended tip; however, in another embodiment, the modified cap does not include the protruding shoulder.

Furthermore, according to another embodiment of the present invention, the mixing port includes a flange receiving surface formed on the bottom end of the first bottle, wherein the orifice is centered within the flange receiving surface, and wherein the seal is affixed to the flange receiving surface such that it covers the orifice. Furthermore, a threaded female nipple having a flange radially formed thereon an end is attached to the flange receiving surface from the first bottle by at least one of sonic welding, heat fusion, or adhesive. Moreover, according to another aspect of the present invention, the flange from the female nipple includes a seal recess for unobstructively receiving the seal.

According to another embodiment of the present invention, the mixing port includes a cylindrical collar formed on the bottom end of the first bottle, wherein the orifice is centered within the collar. A threaded insert having the seal affixed to an inner end thereof, is inserted into the collar and bonded to an inside surface thereof by at least one of sonic welding, heat fusion, force-fit or adhesive.

In another aspect of the present invention, the threaded insert further includes a protruding lip formed within the inner end which is adapted to abut against the protruding shoulder to form a sealed surface. Also, according to another aspect of the present invention, the mixing orifice includes one of a beveled edge or rounded edge formed on a bottom surface thereof to provide extra clearance for the slices when they are pushed in the upright position between the recessed portion defining the extended tip and the orifice.

According to another aspect of the present invention, the packaging system further includes a threaded plug adapted to be installed into the mixing port. Furthermore, another aspect of the present invention may include a docking connector adapted to interconnect the mixing port from the first bottle to the spout of the second bottle having a bottle cap attached thereto. The docking connector may comprise a cylindrical sleeve including a radial wall formed therein to define an upper receiving space adapted to receive the mixing port from the first bottle and a lower receiving space adapted to receive the cap installed on the second bottle.

According to another embodiment of the present invention, a packaging system is provided for storing and mixing a first ingredient component and a second ingredient component. The packaging system includes a first bottle used for storing the first ingredient component. The first bottle may have an optional dispensing port disposed on a top end of the first bottle; however, such a feature is not required in other embodiments. The first bottle further includes a mixing port positioned on a bottom end of the first bottle which includes a mixing orifice disposed there through the bottom end of the first bottle. A seal is integrated within the mixing port. In a preferred embodiment, the seal covers the mixing orifice. The packaging system also includes a second bottle used for storing the second ingredient component. The second bottle preferably includes a conventional bottle spout having a distal edge adapted to be installed into the mixing port of the first bottle. When the bottle spout of the second bottle is installed into the mixing port of the first bottle, the seal from the first bottle is broken by the distal edge from the spout of second bottle, establishing a mixing path between the first and second bottles which allows the first ingredient component to mix with the second ingredient component. It is also noted that the mixing port flows in both directions, such that the ingredient components may be transferred to or from either the first or second bottle.

According to another aspect of the present invention, when the spout of the second bottle is installed into the mixing port of the first bottle, the seal is broken by the distal edge from the spout of the second bottle into slices which are pushed in a generally upright position between the mixing orifice disposed through the bottom end of the first bottle and the distal edge from the spout of the second bottle.

According to yet another aspect of the present invention, the mixing port may comprise a cylindrical collar formed on the bottom end of the first bottle, wherein the mixing orifice is centered within the collar. A threaded insert having the seal affixed to an inner end thereof is inserted into the collar and bonded to an inside surface thereof by at least one of sonic welding, heat fusion, force-fit or adhesive. Moreover, a sealed surface is formed between an outer end of the threaded insert and a cap ring formed on the spout of the second bottle.

According to still yet another aspect of the present invention, the mixing orifice disposed through the bottom end of the first bottle includes one of a beveled edge or rounded edge formed on a bottom surface thereof to provide extra clearance for the slices when they are pushed in the upright position between the mixing orifice and the distal edge from the spout of the second bottle.

According to another aspect of the present invention, a threaded plug is provided which is adapted to be installed into the mixing port. The plug may include a flange formed on an outer end thereof which functions as a stopping mechanism such that the plug cannot puncture the seal Other exemplary embodiments and advantages of the present invention may be ascertained by reviewing the present disclosure and the accompanying drawings.

BRIEF DESCRIPTION OF THE DRAWINGS

The present invention is further described in the detailed description that follows, by reference to the noted drawings by way of non-limiting examples of preferred embodiments of the present invention, in which like reference numerals represent similar parts throughout several views of the drawings, and in which:

FIG. 12 depicts a cross-sectional view of the second embodiment of the mixing port from FIG. 10, and of which further depicts a plug installed into the second embodiment mixing port, according to an aspect of the present invention;

FIG. 13 depicts a cross-sectional view of an exemplary docking connector adapted to interconnect all embodiments of the mixing port positioned on the bottom of the first bottle to the all embodiments of the cap installed on the spout of the second bottle, according to an aspect of the present invention;

FIG. 14 depicts a cross-sectional view of the first bottle with the second embodiment mixing port from FIG. 10 and plug from FIG. 12 installed therein, interconnected to a second bottle with the modified cap from FIG. 6 by utilizing the exemplary docking connector from FIG. 13, according to an aspect of the present invention;

DETAILED DESCRIPTION OF THE INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
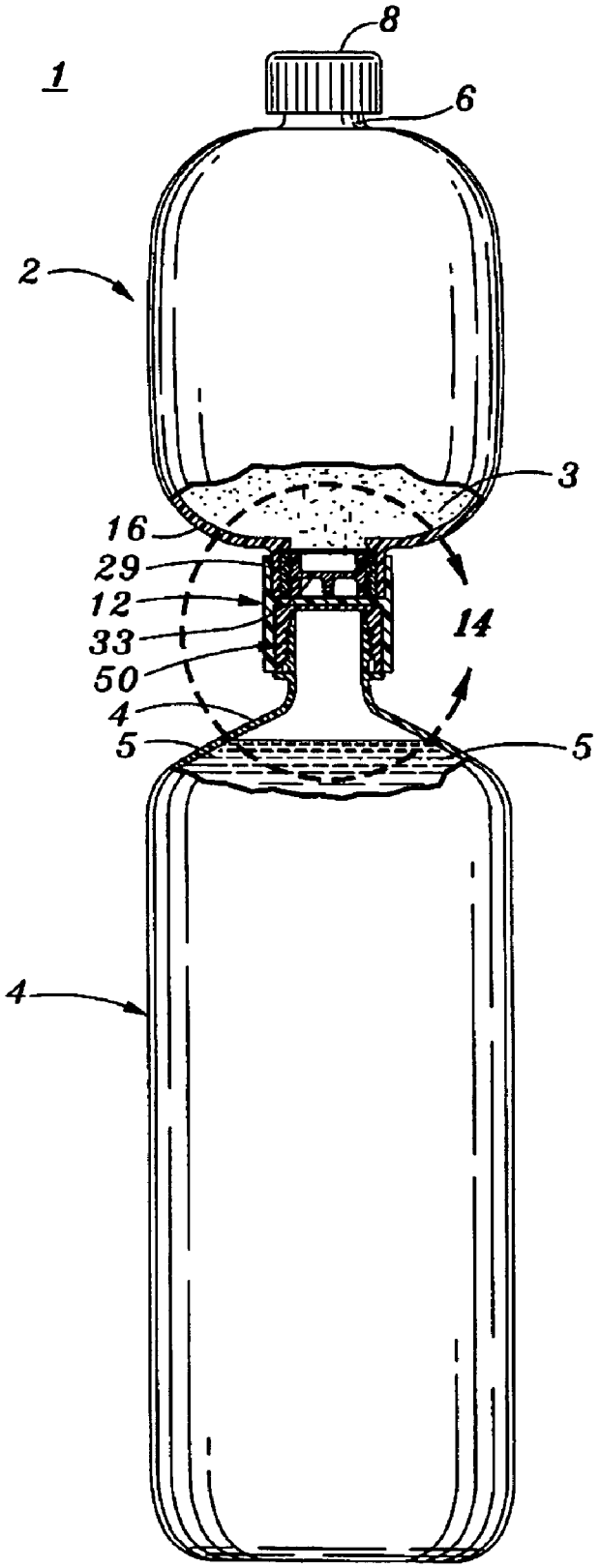
FIG. 1 depicts an exemplary packaging system for storing and mixing a first component ingredient contained in a first bottle and a second component ingredient contained in a second bottle, according to an aspect of the present invention.

FIG. 1 depicts an exemplary packaging system 1 for storing and mixing substance from a first component 3 of an ingredient contained in a first bottle 2 and a second component 5 of an ingredient contained in a second bottle 4, according to an aspect of the present invention. It is noted that the first and second components may be either in powderized form or liquid form (or of a consistency between powder and liquid). The component ingredients may also be granular mixtures, dried grains and or cereals, gel, syrup or any other form of a consumable ingredient substance or solution which may be mixed to form a reconstituted beverage, shake, food product or the like. Examples of the two component substances which may be packaged in the present invention includes powered milk and water, flavored syrup and carbonated soda, protein mix and water/milk, etc.

Figure 2:
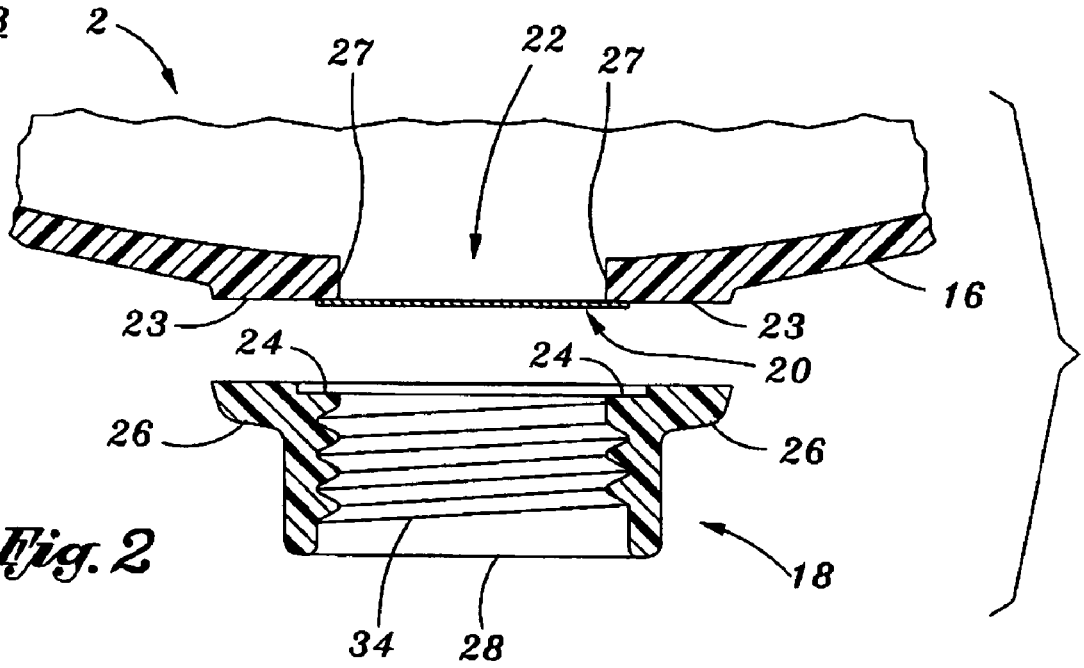
FIG. 2 depicts a cross-sectional view of present invention which includes a first embodiment of a mixing orifice positioned on the bottom of the first bottle with a seal attached thereto, before a threaded female nipple ring is attached to a flange formed on the bottom of the first bottle, according to an aspect of the present invention.
Figure 4:
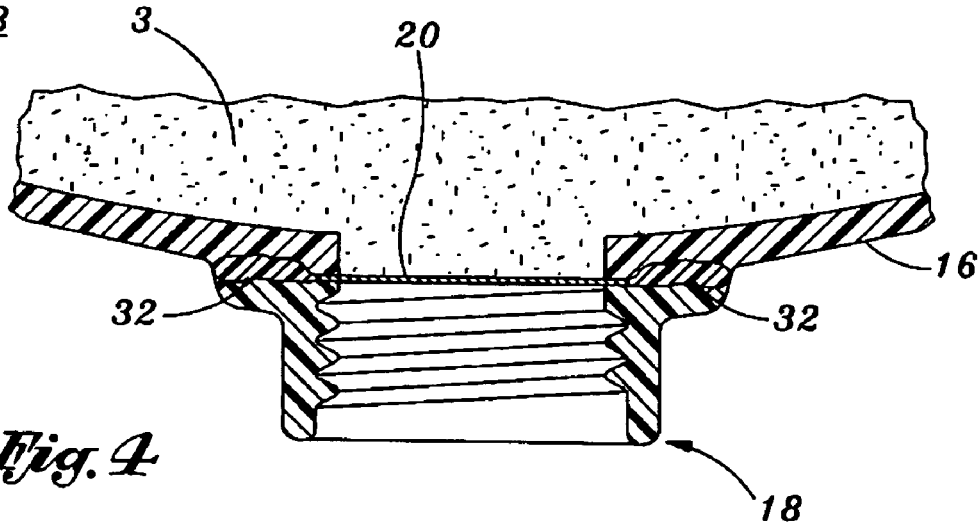
FIG. 4 depicts a cross-sectional view of the mixing orifice from FIG. 2 with the threaded female nipple ring attached to the bottom of the flange formed on the bottom of the bottle, according to an aspect of the present invention.
Figure 7:
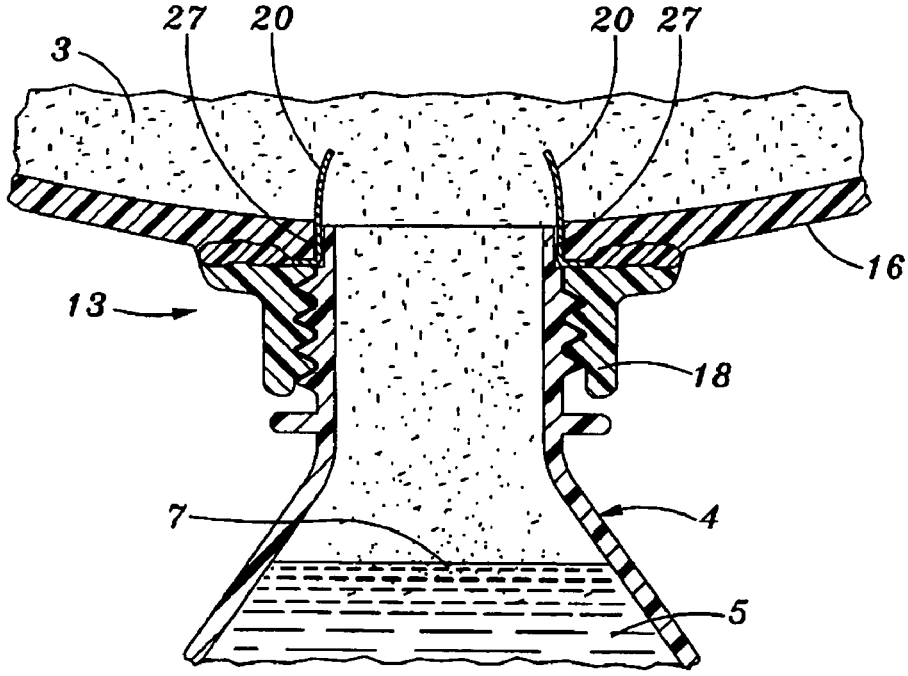
FIG. 7 depicts a cross-sectional view of the first embodiment mixing orifice from FIG. 4 with the modified liquid bottle from FIG. 5 installed therein the first embodiment mixing orifice, wherein the modified bottle is threaded into the female nipple ring of the mixing orifice such that the seal has been broken open allowing the first component to mix with the second component, according to an aspect of the present invention.

In particular, FIG. 1 shows an exemplary embodiment of the present invention in which the first bottle 2 is filled with a first ingredient component 3. The shape and volumetric size of the first bottle 2 may vary depending on the products being packaged and marketed. Therefore, it is recognized that the bottle 4 shown in FIG. 1 is merely exemplary of numerous bottles which may used in the present invention. The first bottle 2 may have an optional dispensing port 6 positioned on the top which is adapted to receive a conventional cap 8. For instance, the dispensing port 6 may have threads formed externally thereon, such that it is adapted to receive a conventional threaded cap 8. Or in another embodiment, the dispensing port 6 does not have threads and the cap 8 is press fit over dispensing port 6 and sealed with a removable strip such as those used on water jugs, milk jugs or orange juice containers. The first bottle 2 also has mixing port 15 (as shown in FIG. 1), 13 or 45 (wherein 13 and 45 are alternative embodiments not shown in FIG. 1) located on the bottom of the first bottle 2 which is used to introduce the first ingredient component 3 into the second bottle 4, or vice-versa. The present invention provides three exemplary embodiments of the mixing port 13, 15 and 45. The first embodiment of the mixing port 13 is shown in FIGS. 2, 4 and 7. The second embodiment of the mixing port 15 is shown in FIGS. 1, 8-12 and 14. The third embodiment of the mixing port 45 is shown in FIGS. 15 through 19. Detailed descriptions of the various embodiments of the mixing ports 13, 15 and 45 will be provided later in the specification.

Figure 19:
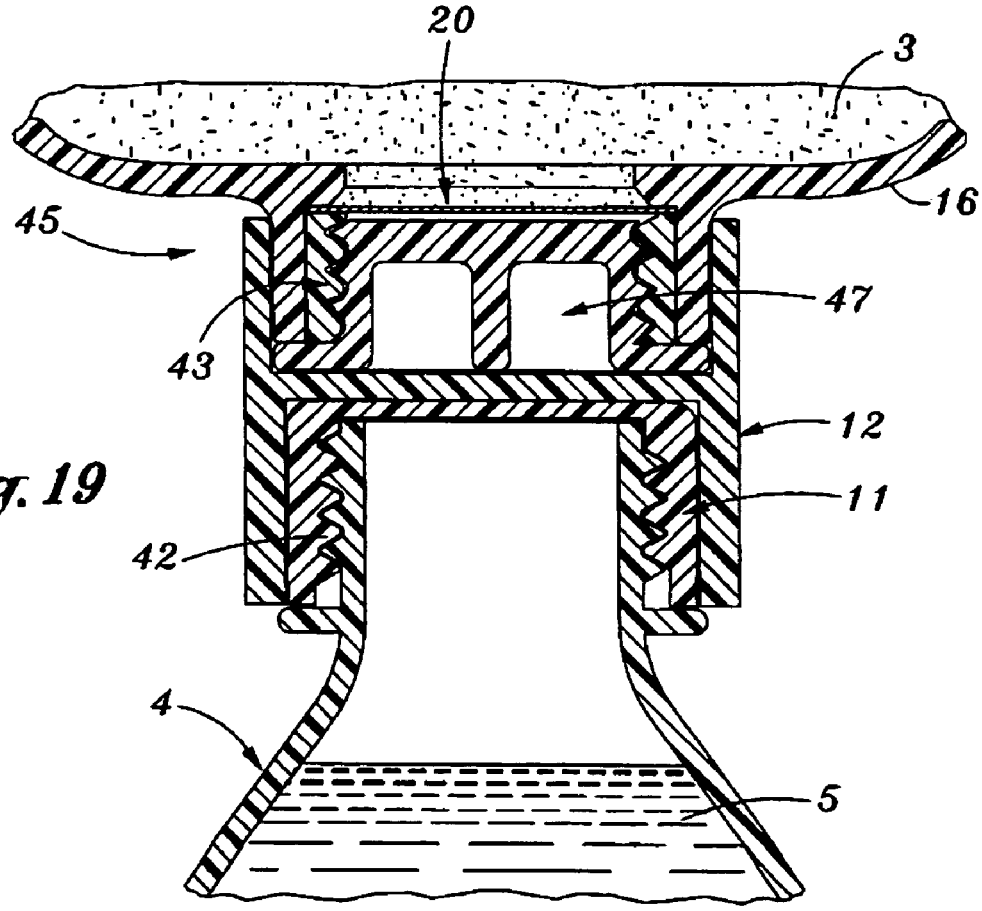
FIG. 19 depicts a cross-sectional view of the first bottle with the third embodiment mixing port from FIG. 16 and plug from FIG. 18 installed therein, interconnected to a second bottle with a conventional spout and cap by utilizing the exemplary docking connector from FIG. 13, according to an aspect of the present invention.

FIG. 1 also shows a second bottle 4 which is filled with a second ingredient component 5. The shape and volumetric size of the second bottle 4 may vary depending on the products being packaged and marketed. Therefore, it is recognized that the bottle 4 shown in FIG. 1 is merely exemplary of numerous bottles which may used in the present invention. In the first and second embodiments of the present invention, the bottle spout 38 is slightly modified from conventional or standard threaded bottle necks which are well known. The modified bottle spout 38, which has an extended distal tip 44, is shown in FIGS. 5-7 and 11. It is also noted that the modified bottle spout 38 may use a modified bottle cap 50 which is shown in FIGS. 6 and 14. While in the third embodiment of the present invention, a standard or conventional threaded bottle spout 9 may be utilized without any modification whatsoever. An exemplary standard or conventional threaded bottle spout 9 is shown in FIG. 19. It is noted that the conventional bottle spout 9 may also utilize conventional bottle cap 11 as depicted in FIG. 19. Detailed descriptions of the bottles spouts 38, 9 will be provided later in the specification.

The present invention also provides an exemplary docking connector 12 which allows the first bottle 2 to be stacked on top of the second bottle 4. The docketing connector 12 may be utilized with any of the embodiments of the mixing ports 13, 15 or 45 from the first bottle 2 in conjunction with the any of the bottle neck embodiments 38, 11 of second bottle 4. The docking connector 12 is not intended to enable the first component 3 from the first bottle 2 to flow directly into the second bottle 4 upon an operative movement such as a twist or push. Rather, the docking connector 12 of the present invention is provided for coupling the first and second containers 2, 4 together containing the first and second component ingredients 3, 5, such as powdered milk and drinking water, so that they can be marketed and sold together as a complete package if so desired. Moreover, the design of the docking connector 12 is preferred to be as simple as possible to keep cost down to a minimum. An exemplary embodiment of the docking connector 12 is provided in FIGS. 1, 13-14 and 19. A detailed description of the docking connector 12 will be provided later in the specification.

FIG. 2 depicts a cross-sectional view of a first embodiment of the present invention which includes a mixing port 13 positioned/formed at the bottom of the first bottle 2. In particular, a mixing orifice 22 is disposed through the bottom of the first bottle 2 which is preferably circular and of which is defined by an upright cylindrical surface 27. The bottom of the first bottle 2 also includes a planar flange surface 23 which is adapted to receive a seal (see also FIG. 3) and flange 26 from a female nipple ring 18. The hermatic seal 20 is first applied to the flange surface 23 with adhesive before the female nipple 18 is permanently attached to the flange surface 23 formed on the bottom of the first bottle 2. The female nipple 18 is basically a threaded circular and cylindrical nipple which includes a flange portion 26 which is adapted to mate to the planar flange surface 23 formed on the bottom of the first bottle 2. The female nipple 18 utilizes conventional female threads 34 which are adapted to receive conventional male threads 42 (see FIGS. 5 and 19). It is further noted that a seal recess 24 may be formed in the bottom of the flange portion 26 such that when the female nipple 18 is attached to the bottom of the first bottle 2, the perforated seal 20 is unobstructively received inside the seal recess 24.

Figure 3:
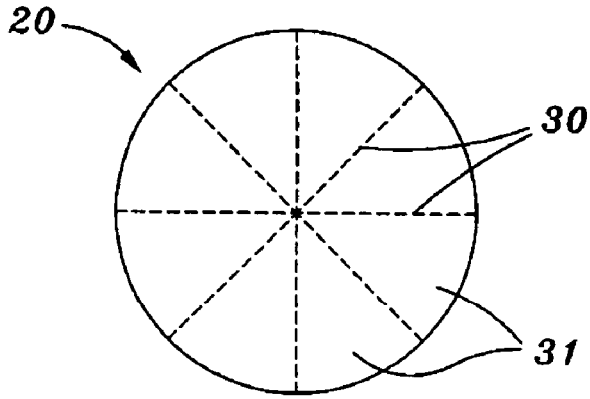
FIG. 3 depicts a top view of an exemplary seal from FIG. 2, according to an aspect of the present invention.

FIG. 3 depicts a top view of a seal 20 from FIG. 2 (as well as FIGS. 4, 7, 9-12, 14-19), according to an aspect of the present invention. A series of intersecting perforations, indentions, or embossed lines or pre-pressed seams 30 which may be formed in the seal 20 to assist the breaking of the seal into "slices" 31 when the second bottle is installed into the mixing port 13 (and 15, 45). The seal 20 may be made from any material known to be used in food or beverage packaging seals. Further, the material used for the seal 20 may be selected depending on whether powder or liquid is to be contained in the first bottle 2. For a liquid component, a non-porous seal which does not leak is preferred.

FIG. 4 depicts a cross-sectional view of the first embodiment mixing port 13 from the first bottle 2 with the seal 20 attached thereto, and with the threaded female nipple ring 18 attached to the flange receiving surface 23 formed on the bottom of the first bottle 2, according to an aspect of the present invention. The female nipple 18 is preferably fused together with the first bottle 2 through sonic welding, heat fusion, glue, adhesive or any other known method to bond plastic parts together. As is illustrated in FIG. 4, a fusion zone 32 may be formed when sonic welding or heat bonding is used to attach the female nipple 18 to the bottom of the first bottle 2.

Figure 5:
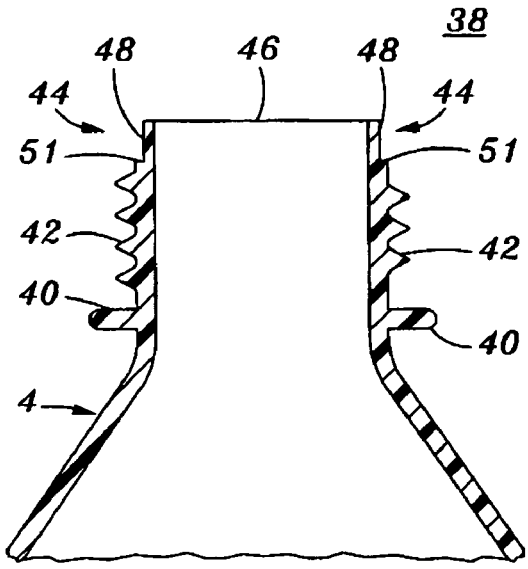
FIG. 5 depicts a cross-sectional view of an exemplary modified liquid bottle adapted to be utilized with the first embodiment mixing orifice from FIG. 4, wherein the spout of the bottle includes and extended tip, according to an aspect of the present invention.
Figure 6:
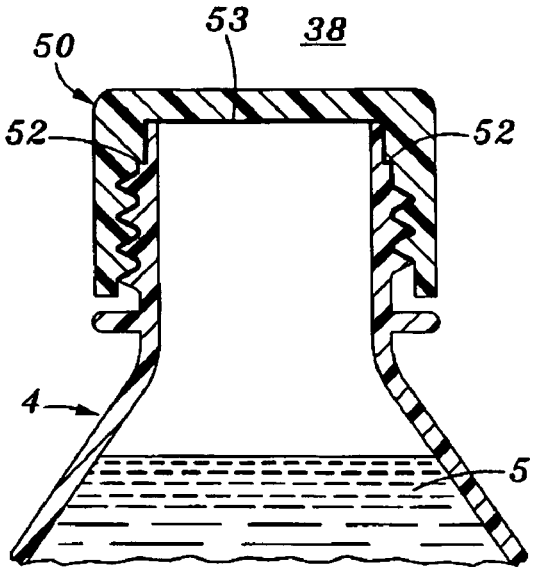
FIG. 6 depicts the cross-sectional view of the spout of the modified liquid bottle with the extended tip from FIG. 5 with a modified bottle cap which is adapted to receive the extended tip from the modified liquid bottle, according to an aspect of the present invention.

FIG. 5 depicts a cross-sectional view of a modified bottle spout 38 of the second bottle 4 with an extended tip 44, according to an aspect of the present invention. The extended tip 44 is used to puncture the seal 20 (see FIG. 7). The exemplary extended tip 44 is defined by a recessed portion 48 which forms a sealing shoulder 51. Besides the extended tip 44 and sealing shoulder 51, all other features of the modified bottle spout 38 are the same as a conventional or standard bottle spout, including conventional male threads 42 and a radial cap ring 40.

FIG. 6 depicts the cross-sectional view of the modified bottle spout 38 from the second bottle 4 with the extended tip 44 from FIG. 5, and a modified bottle cap 50 attached thereto which is adapted to receive the extended tip 44, according to an aspect of the present invention. The modified cap 50 may be designed similar to any conventional or standard bottle cap, except it further is adapted to receive the extended tip 44. In particular instance, the exemplary cap 50 is made taller to accept the length of the extended tip 44 and further includes protruding shoulder 52 which is formed in the top portion of the cap 50 such that the protruding shoulder 52 will be directly compressed against the sealing shoulder 51 of the modified bottle spout 38 such that a proper seal is formed. Furthermore, the distal edge of the spout 38 is adapted abut against the bottom side of the cap 53 such that a seal is formed between the modified cap 50 and the extended tip 44 of the second bottle 4.

FIG. 7 depicts a cross-sectional view of the first embodiment mixing port 13 from FIG. 4 with the second bottle 4 having the modified bottle spout 38 from FIG. 5 installed into the female nipple ring 18 such that the perforated seal 20 has been broken open allowing the first component 3 from the first bottle 2 to mix with the second component 5 contained in the second bottle 4 to form the desired mixed product 7, according to an aspect of the present invention. As can be seen in FIG. 7, the extended tip 44 from the second bottle 4 pushes the seal 20 up along the upright cylindrical surface 27 formed in the mixing orifice 22 disposed through the bottom of the first bottle 2, thereby breaking the seal into slices 31.

Figure 8:
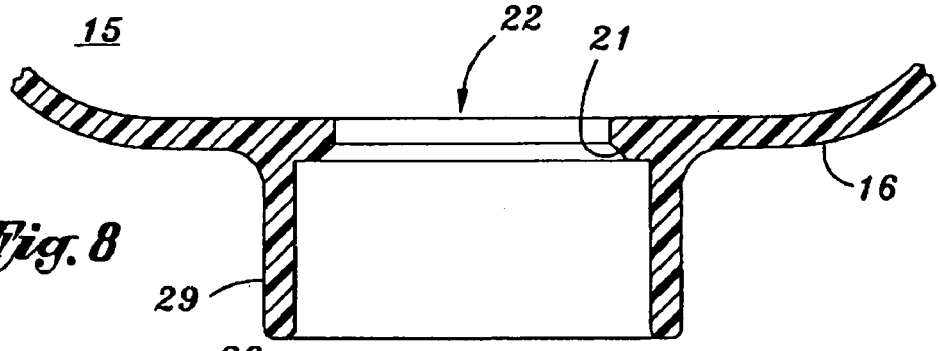
FIG. 8 depicts a cross-sectional view of a second embodiment of a mixing port positioned on the bottom of the first bottle which utilizes a cylindrical collar, according to an aspect of the present invention.

FIG. 8 depicts a cross-sectional view of a portion of the second embodiment of the mixing port 15 which is cylindrical collar 29 formed on the bottom 16 of the first bottle 2, according to an aspect of the present invention. A mixing orifice 22 is disposed through the bottom 16 of the first bottle 2 which is preferably circular. The bottom edge of the mixing orifice 22 also includes a beveled edge or rounded edge 21 which is provided to allow the seal 20 to easily bend upwards (see FIG. 11). Furthermore, a backing shoulder 57 is formed contiguous to the beveled edge or rounded edge 21. The backing shoulder 57 and beveled edge or rounded edge 21 feature will be further discussed later in the specification.

Figure 9:
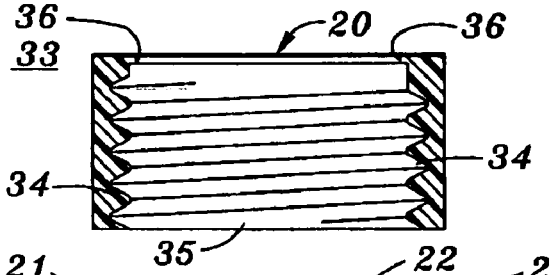
FIG. 9 depicts a cross-sectional view of a threaded insert utilized with the second embodiment of the mixing port, wherein the threaded insert is adapted to be received into the cylindrical collar from FIG. 8, according to an aspect of the present invention.

FIG. 9 depicts a cross-sectional view of a threaded insert 33 utilized with the second embodiment of the mixing port 15, wherein the threaded insert 33 is adapted to be received into the cylindrical collar 29 from FIG. 8, according to an aspect of the present invention. The threaded insert 33 includes conventional female receiving threads 34 which are adapted to receive conventional male threads 42 disposed on the spout of the second bottle 4. As shown in FIG. 9, a protruding lip 36 is disposed on the upper end of the insert 33. Additionally, the seal 20 (from FIG. 3) is applied to the upper end of the insert 33. The function of the protruding lip 36 feature will be further discussed later in the specification.

Figure 10:
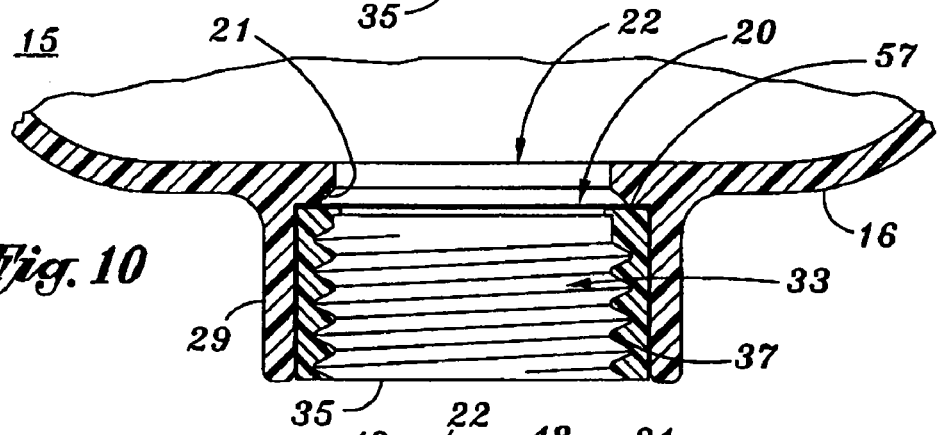
FIG. 10 depicts a cross-sectional view of the second embodiment of the mixing port which shows the threaded insert from FIG. 9 inserted into the cylindrical collar from FIG. 8, according to an aspect of the present invention.

FIG. 10 depicts a cross-sectional view of the second embodiment mixing port 15 which shows the threaded insert from FIG. 9 inserted into the cylindrical collar from FIG. 8, according to an aspect of the present invention. As can be seen from FIG. 10, the upper end of the insert 33 in which the seal is disposed thereto, is adapted to abut against the backing shoulder 57 formed in the bottom 16 of the first bottle. As a result, the outer perimeter of the seal is compressed between the backing shoulder 57 and the upper end of the threaded insert 33. The threaded insert 33 bonded to the inner surface of the collar 29 through sonic welding, heat fusion, glue, adhesive or any other known method to bond plastic parts together. It is noted that the external edge 35 of the threaded insert 33 is preferably about even with the external edge 37 of the collar 29.

Figure 11:
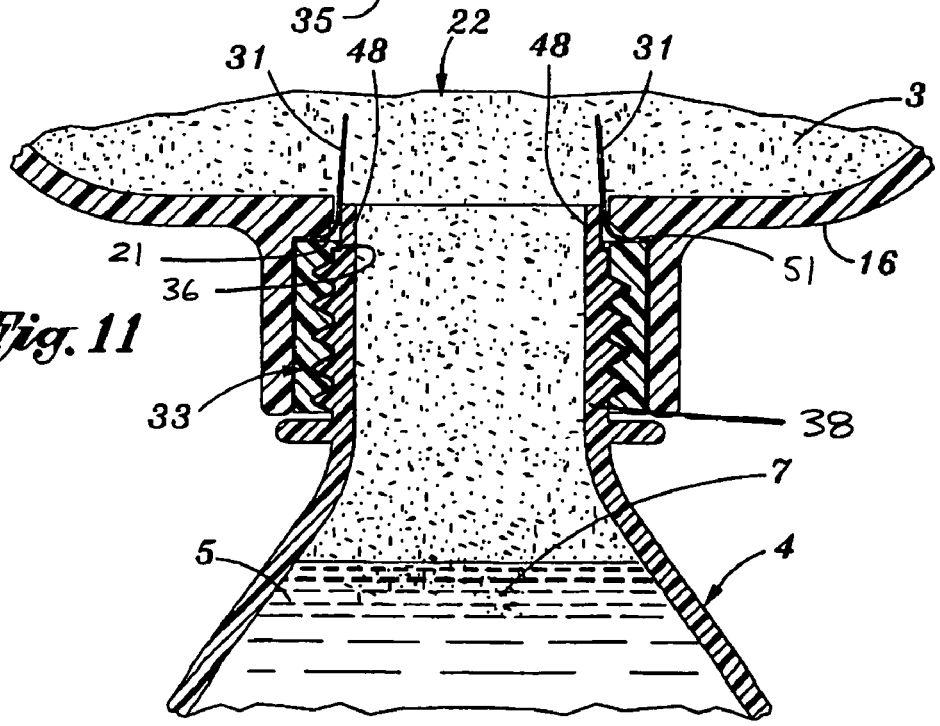
FIG. 11 depicts a cross-sectional view of the second embodiment mixing port from FIG. 10 with the modified liquid bottle from FIG. 5 installed therein, wherein the modified bottle is threaded into the threaded insert such that the perforated seal has been broken open allowing the first component to mix with the second component, according to an aspect of the present invention.

FIG. 11 depicts a cross-sectional view of the second embodiment mixing port 15 from FIG. 10 with the modified liquid bottle spout 38 from FIG. 5 installed therein, wherein the modified bottle spout 38 is threaded into the threaded insert 33 such that the perforated seal 20 has been broken open into slices 31 allowing the first ingredient component 3 from the first bottle 2 to mix with the second ingredient component 5 from the second bottle 4 to form a reconstituted beverage or food product 7, according to an aspect of the present invention. It is noted that an aspect of this embodiment of the present invention is that the sealing shoulder 51 from the neck of the modified bottle spout 38 forms a seal with the protruding lip 36 formed on the upper end of the threaded insert 33. Furthermore, it is noted that the beveled edge 21 formed on the lower surface of the mixing orifice 22 formed in the first bottle 4 provides clearance for the slices 31 of the seal 20 to bend upward. Further, in another embodiment of the present invention (similar to that shown in FIG. 17, except utilizing the modified bottle spout 38), the protruding lip 36 is not required. In this embodiment, the recessed portion 48 formed on the extended tip 44 of the modified bottle spout 38, seals directing against the broken upturned seal 20 by pushing the seal 20 against the side wall of the mixing orifice 22. Thereby a seal if formed between the side wall of the mixing orifice 22, the seal, and the recessed portion 48 of the extended tip 44.

FIG. 12 depicts a cross-sectional view of the second embodiment of the mixing port 15 from FIG. 10, and of which further depicts a plug 39 installed into the second embodiment mixing port 15, according to an aspect of the present invention. In particular, the plug 39 is configured such that it may be flushly installed into the mixing port 15 without puncturing the seal 20. This is accomplished because the upper end of the plug 33 is stopped by the protruding lip 36 formed on the upper end of the insert 33. The plug 39 utilizes conventional male threads 42 which are adapted to be received by the conventional female threads 34 formed in the insert 33. FIG. 12 further depicts a gripping handle 41 which is formed on the lower end of the plug 33 which has voids formed adjacent thereto for receiving fingertips of the person installing the plug 33.

FIG. 13 depicts a cross-sectional view of an exemplary docking connector 12 adapted to interconnect all embodiments of the mixing ports 13, 15 and 45 (see FIG. 16) positioned on the bottom 16 of the first bottle 2 to the all embodiments of the cap 38, 11 installed on the spout of the second bottle 4, according to an aspect of the present invention. The docking connector 12 is preferably formed from cylindrically shaped sleeve 68 which has a radial wall 70 formed therein. An upper receiving space 74 is provided which is adapted to receive mixing ports 13, 15 or 45. A lower receiving space 72 is provided which is adapted to receive either the modified bottle cap 38 or the conventional bottle cap 11.

FIG. 14 depicts a cross-sectional view of the first bottle 2 with the second embodiment mixing port 15 from FIG. 10 and plug from FIG. 12 installed therein, interconnected to a second bottle 4 with the modified cap 38 from FIG. 6 by utilizing the exemplary docking connector 12 from FIG. 13, according to an aspect of the present invention. Since the plug 33 is flush with the external edge of the collar 29, the mixing port 15 may be installed via slip fit into the upper receiving space 74 without any interference from the plug 39. Similarly, the second bottle 4 with the modified cap 38 attached thereto may be installed via slip fit into the lower receiving space 72. As already discussed, the docking connecter 12 is mainly used for packaging, shipping and marketing display purposes.

Figure 15:
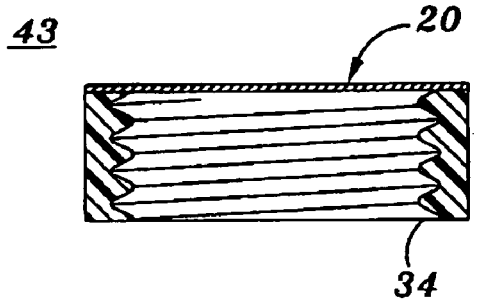
FIG. 15 depicts a cross-sectional view of another threaded insert utilized with a third embodiment of the mixing port positioned on the bottom of the first bottle, wherein the threaded insert is adapted to be received into a shortened cylindrical collar similar to the collar from FIG. 8, according to an aspect of the present invention.

FIG. 15 depicts a cross-sectional view of another threaded insert 43 utilized with a third embodiment of the mixing port 45 (see FIG. 16), wherein the threaded insert 43 is adapted to be received into a shortened cylindrical collar 55 similar to collar 29 from FIG. 8, according to an aspect of the present invention. As can be seen in FIG. 15, a perforated seal 20 (see FIG. 3) is affixed to the upper end of the insert 43. In particular, the threaded insert 43 includes conventional female receiving threads 34 which are adapted to receive conventional male threads 42 disposed on the spout of the second bottle 4 which has a conventional spout 11 (see FIG. 17).

Figure 16:
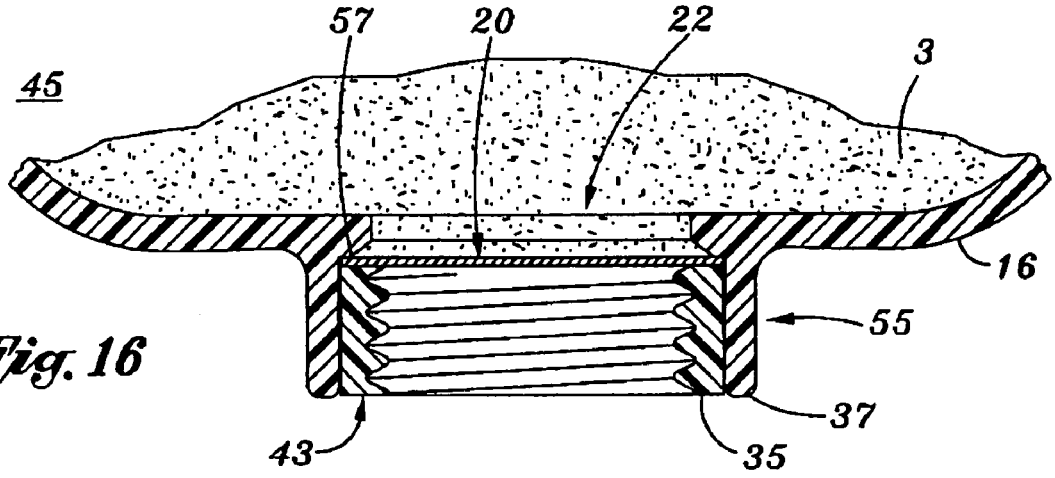
FIG. 16 depicts a cross-sectional view of the third embodiment of the mixing port positioned on the bottom of the first bottle which has the threaded insert from FIG. 15 inserted into the cylindrical collar, according to an aspect of the present invention.

FIG. 16 depicts a cross-sectional view of the third embodiment of the mixing port 45 positioned on the bottom of the first bottle 2 which has the threaded insert 43 from FIG. 15 inserted into the shortened cylindrical collar 55, according to an aspect of the present invention. As can be seen from FIG. 16, the upper end of the insert 33 in which the seal 20 is affixed thereto, is adapted to abut directly against the backing shoulder 57 formed in the bottom 16 of the first bottle 2. As a result, the outer perimeter of the seal 20 is compressed between the backing shoulder 57 and the upper end of the threaded insert 33. The threaded insert 33 is bonded to the inner surface of the shortened collar 55 through sonic welding, heat fusion, glue, adhesive or any other known method to bond plastic parts together. It is noted that the external edge 35 of the threaded insert 43 is preferably about even with the external edge 37 of the shortened collar 55.

Figure 17:
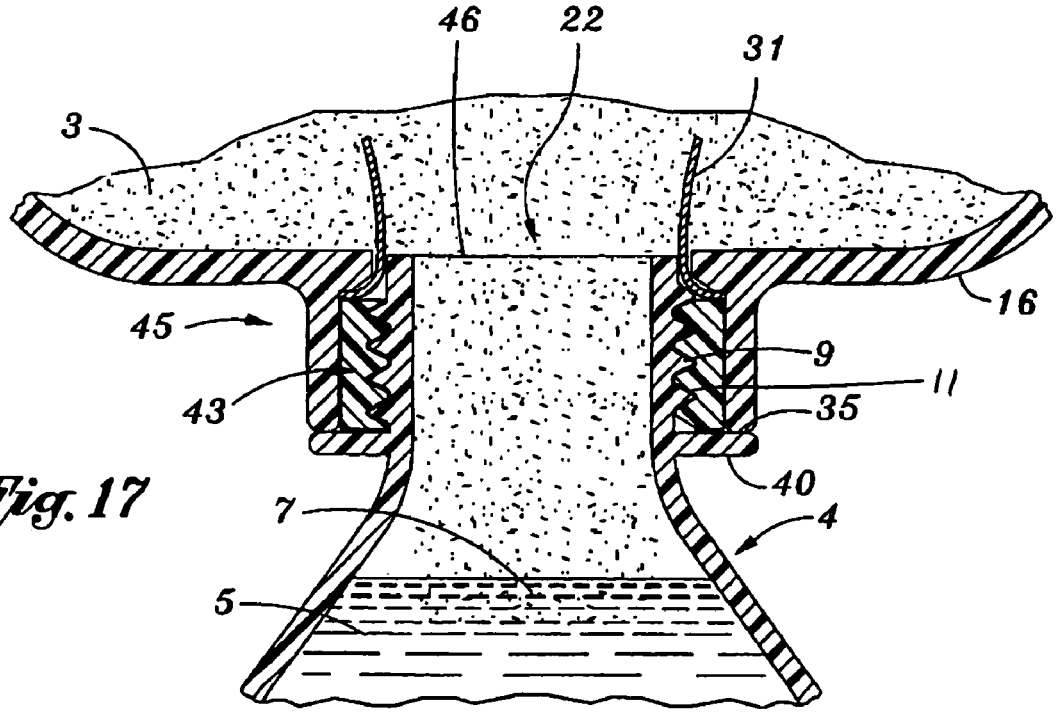
FIG. 17 depicts a cross-sectional view of the third embodiment mixing port from FIG. 16 with a conventional liquid bottle having a conventional threaded spout installed therein such that the seal has been broken open allowing the first component to mix with the second component, according to an aspect of the present invention.

FIG. 17 depicts a cross-sectional view of the third embodiment mixing port 45 from FIG. 16 with the second bottle 4 having a conventional threaded spout 11 installed therein such that the perforated seal 20 has been broken open into slices 31 allowing the first ingredient component 3 to mix with the second ingredient component 5 to form a reconstituted beverage of food product 7, according to an aspect of the present invention. It is noted that an aspect of this embodiment of the present invention is that a sealing surface is formed between the upper surface of the cap ring 40 and the lower surface 35 of the insert 43. Furthermore, it is noted that the beveled edge 21 formed on the lower surface of the mixing orifice 22 formed in the first bottle 4 provides clearance for the slices 31 of the seal 20 to bend upward.

Figure 18:
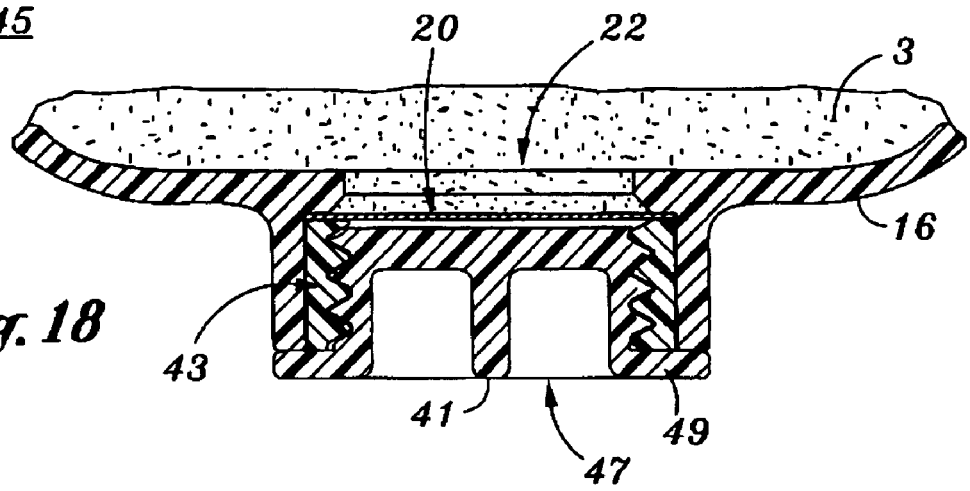
FIG. 18 depicts a cross-sectional view of the third embodiment of the mixing port from FIG. 16, and of which further depicts an alternative plug installed into the third embodiment mixing port, according to an aspect of the present invention.

FIG. 18 depicts a cross-sectional view of the third embodiment of the mixing port 45 from FIG. 16, and of which further depicts an alternative plug 47 installed into the third embodiment mixing port 45, according to an aspect of the present invention. In particular, the alternative plug 47 includes a flange 49 formed on the outer end thereof which functions as a stopping mechanism such that the plug 47 cannot puncture the seal 20. The plug 47 utilizes conventional male threads 42 which are adapted to be received by the conventional female threads 34 formed in the insert 43. FIG. 18 further depicts a gripping handle 41 which is formed on the lower end of the plug 47 which has voids formed adjacent thereto for receiving fingertips of the person installing the plug 47.

FIG. 19 depicts a cross-sectional view of the first bottle 2 with the third embodiment mixing port 45 from FIG. 16 and alternative plug 47 from FIG. 18 installed therein, interconnected to a second bottle 4 with a conventional spout 9 and cap 11 by utilizing the exemplary docking connector 12 from FIG. 13, according to an aspect of the present invention.

Although the invention has been described with reference to several exemplary embodiments, it is understood that the words that have been used are words of description and illustration, rather than words of limitation. Changes may be made within the purview of the appended claims, as presently stated and as amended, without departing from the scope and spirit of the invention in its aspects. Although the invention has been described with reference to particular means, materials and embodiments, the invention is not intended to be limited to the particulars disclosed; rather, the invention extends to all functionally equivalent structures, methods, and such uses are within the scope of the appended claims.

What is claimed is:

1. A packaging system for storing and mixing a first ingredient component and a second ingredient component, the packaging system comprising:

a first bottle used for storing the first ingredient component, the first bottle comprising, a mixing port positioned on a bottom end of the first bottle which includes a mixing orifice disposed there through the bottom end of the first bottle; and a seal integrated within the mixing port; and a second bottle used for storing the second ingredient component, the second bottle including, a conventional bottle spout adapted to be installed into the mixing port of the first bottle, and an extended tip defined by a recessed portion and a recessed shoulder formed on a distal end of the spout, wherein when the bottle spout of the second bottle is installed into the mixing port of the first bottle, the seal from the first bottle is broken by the extended tip formed on the second bottle, establishing a mixing path between the first and second bottles which allows the first ingredient component to mix with the second ingredient component, wherein the mixing port comprises:

a flange receiving surface formed on the bottom end of the first bottle, wherein the orifice is centered within the flange receiving surface, and wherein the seal is affixed to the flange receiving surface such that it covers the orifice; and a threaded female nipple having a flange radially formed thereon an end, wherein the flange is attached to the flange receiving surface from the first bottle by at least one of sonic welding, heat fusion, or adhesive.

2. The packaging system according to claim 1, the flange from the female nipple including a seal recess for unobstructively receiving the seal.

3. A packaging system for storing and mixing a first ingredient component and a second ingredient component, the packaging system comprising:

a first bottle used for storing the first ingredient component, the first bottle comprising, a mixing port positioned on a bottom end of the first bottle which includes a mixing orifice disposed there through the bottom end of the first bottle; and a seal integrated within the mixing port; and a second bottle used for storing the second ingredient component, the second bottle including, a conventional bottle spout adapted to be installed into the mixing port of the first bottle, and an extended tip defined by a recessed portion and a recessed shoulder formed on a distal end of the spout, wherein when the bottle spout of the second bottle is installed into the mixing port of the first bottle, the seal from the first bottle is broken by the extended tip formed on the second bottle, establishing a mixing path between the first and second bottles which allows the first ingredient component to mix with the second ingredient component, wherein the mixing port comprises:

a cylindrical collar formed on the bottom end of the first bottle, wherein the orifice is centered within the collar; and a threaded insert having the seal affixed to an inner end thereof, wherein the insert is inserted into the collar and bonded to an inside surface thereof by at least one of sonic welding, heat fusion, force-fit or adhesive.

4. The packaging system according to claim 3, the threaded insert further comprising a protruding lip formed within the inner end which is adapted to abut against the protruding shoulder to form a sealed surface.

5. The packaging system according to claim 3, wherein the orifice includes one of a beveled edge or rounded edge formed on a bottom surface thereof to provide extra clearance for the slices when they are pushed in the upright position between the recessed portion defining the extended tip and the orifice.

6. A packaging system for storing and mixing a first ingredient component and a second ingredient component, the packaging system comprising:

a first bottle used for storing the first ingredient component, the first bottle comprising, a mixing port positioned on a bottom end of the first bottle which includes a mixing orifice disposed there through the bottom end of the first bottle; and a seal integrated within the mixing port; and a second bottle used for storing the second ingredient component, the second bottle including a conventional bottle spout having a distal edge adapted to be installed into the mixing port of the first bottle, wherein when the bottle spout of the second bottle is installed into the mixing port of the first bottle, the seal from the first bottle is broken by the distal edge from the spout of second bottle, establishing a mixing path between the first and second bottles which allows the first ingredient component to mix with the second ingredient component to create a reconstituted beverage or food product, and wherein the mixing port comprises:

a cylindrical collar formed on the bottom end of the first bottle, wherein the mixing orifice is centered within the collar; and a threaded insert having the seal affixed to an inner end thereof, wherein the insert is inserted into the collar and bonded to an inside surface thereof by at least one of sonic welding, heat fusion, force-fit or adhesive.

7. The packaging system according to claim 6, wherein a sealed surface is formed between an outer end of the threaded insert and a cap ring formed on the spout of the second bottle.

* * * * *